United States Patent [19]

Terral

[11] Patent Number: 5,042,584

[45] Date of Patent: Aug. 27, 1991

[54] STACKED WATER REGULATOR AND METHOD OF USE

[75] Inventor: Ben D. Terral, Huntsville, Tex.

[73] Assignee: McMurray Oil Tools, Inc., Huntsville, Tex.

[21] Appl. No.: 622,862

[22] Filed: Dec. 5, 1990

[51] Int. Cl.[5] ..... E21B 23/03; E21B 34/10

[52] U.S. Cl. ..... 166/305.1; 166/117.5; 166/319; 166/374

[58] Field of Search ..... 166/305.1, 374, 117.5, 166/117.6, 269, 386, 319

[56] References Cited

U.S. PATENT DOCUMENTS 3,130,784 4/1964 Pennington, II ..... 166/269
3,727,684 4/1973 Terral et al. ..... 166/117.5
4,239,082 12/1980 Terral ..... 166/117.5
4,505,331 3/1985 Akkerman ..... 166/117.5
4,969,521 11/1990 Sanchez ..... 166/269

*Primary Examiner*—Stephen J. Novosad

[57] ABSTRACT

A stacked water injection regulator for controlling liquid flow into a subterranean formation having a bore hole therein, including having a mandrel having a single side pocket, a multiplicity of longitudinally aligned and physically connected liquid flow regulators and a single latching means for securing regulators in the pocket. The mandrel and the regulators together form at least two axially opposite flow paths from the interior of the bore hole to common injection ports at the exterior of the mandrel in fluid communication with the subterranean formation.

3 Claims, 3 Drawing Sheets

STACKED WATER REGULATOR AND METHOD OF USE

A. FIELD OF THE INVENTION

This invention relates to apparatus and methods for controlling liquid injection from a bore hole into a subterranean formation through which the bore hole has been drilled. More particularly, the invention relates to novel arrangement of multiple valves for liquids injection into waterfloods or formation treatment which permits a large liquid flow at a predetermined maximum flow rate.

B. PRIOR ART

Various attempts have been made at controlling liquid injection from the bore hole of a drilled well into a subterranean formation. Attempts to control flow rate of fluids to be injected in a waterflood operation from the surface have proved difficult in operation. The hydrostatic head from the surface to the depth of the formation and the pressure at which surface pumps operate can be controlled, but the back pressure to flow which the formation exhibits and the degree of saturation of the formation change over time. Since it is important to control flow rate so as not to damage an oil-bearing formation in the waterflood process, the best mechanism of control is a limiting regulator adjacent the depth of the formation.

In large waterfloods, the limiting feature of such regulators is the diameter of the bore hole, the mandrel therein and the side pocket into which the flow regulation valve must fit. The larger the size of casing, the more expensive the installation becomes. To meet the problem of large flow requirements in large waterfloods, some attempts have been made to place multiple side pockets in the mandrel, each holding a single regulator. In a standard 7⅞" hole, the multiple side pockets placed along the periphery of the mandrel in axial cross-section pose two problems. First, flow along the inner bore of the mandrel is restricted. Second, multiple trips are required to remove or to insert the valves.

C. SUMMARY OF THE INVENTION

The present invention includes a mandrel with an axial passage therethrough and a single side pocket for receiving a multiplicity of flow regulators. The side pocket is in fluid communication with the axial passage in at least two places and with an adjacent subterranean formation through a common flow port along the longitudinally central exterior portion of the mandrel. A multiplicity of longitudinally aligned and physically connected flow regulators are inserted into the side pocket, each of which permit a maximum rate of liquid flow therethrough in axially opposite flow directions from the axial passage to the common port.

The method of the present invention includes the steps of flowing a liquid from within central passage of the mandrel through at least two flow paths, with at least two of the flow paths being axially opposed, limiting the flow rate along each of the paths to a predetermined maximum and combining the flow from each of said flow paths after the limiting step for injection into the formation.

D. BRIEF DESCRIPTION OF THE DRAWINGS

FIG. 1A is the upper portion of the mandrel and flow regulators and FIG. 1B is the lower portion thereof.

E. DESCRIPTION OF THE PREFERRED EMBODIMENT

Figure 3:
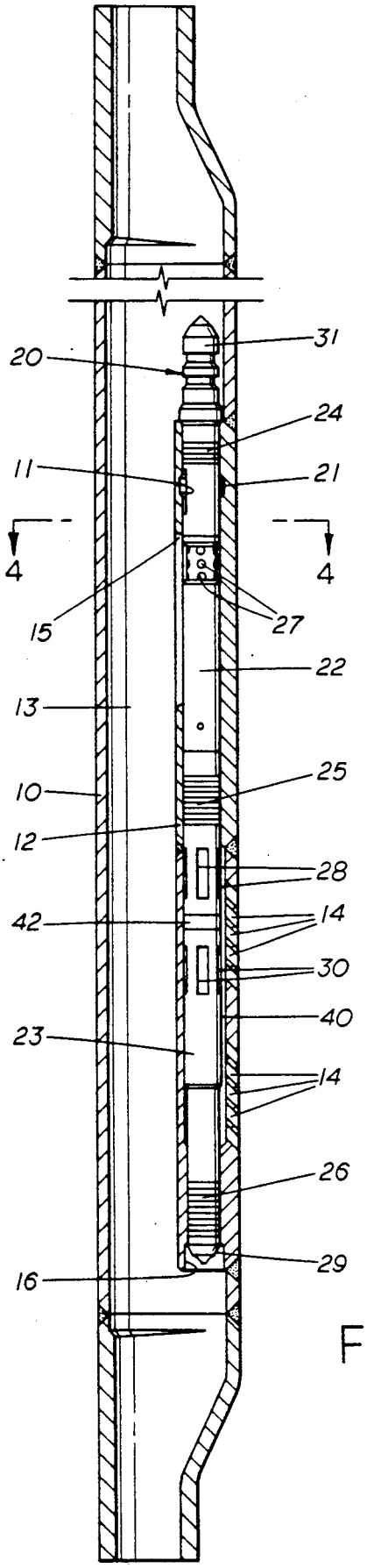
FIG. 3 is a simplified cross-section of the mandrel and a side elevation view of the valve therein.
Figure 4:
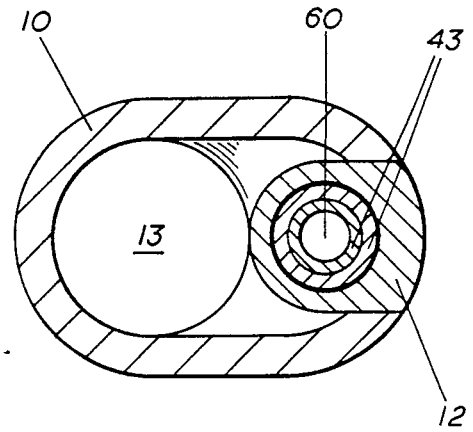
FIG. 4 is an axial cross-sectional view of the mandrel and valve therein taken along 4–4 of FIG. 3.

Referring first to FIG. 3, a mandrel 10 is shown having a side pocket 12 therein. Mandrel 10 is oblong in cross-section as shown in FIG. 4, but may be cylindrical if desired. Mandrel 10 is inserted at a subsurface point into a string of water injection tubing (not shown) which conducts water from pumps (not shown) at the wellhead installation on the surface to the axial passage 13 of mandrel 10. Mandrel 10 also includes a locking detent 11 to receive a locking key 21 mounted on a water flow valve assembly generally designated by the numeral 20. The function of locking detent 11 and locking key 21 will be discussed below. Mandrel 10 also includes a plurality of exit ports 14 which inject water which has passed from the surface pumps, through axial passage 13 and through water flow valve assembly 20 into the subterranean formation (not shown).

Water flow valve assembly 20 includes in this embodiment the longitudinally aligned upper flow valve 22 and lower flow valve 23. Water flow valve assembly 20 is a unitary piece and is placed in side pocket 12 by a wireline (not shown) in a single wireline operation. Water flow valve assembly 20 is locked into place in side pocket 12 by engaging locking key 21 into locking detent 11 of Mandrel 10. Water flow valve assembly 20 is sealed in water-tight engagement with side pocket 12 by an upper seal 25 and a lower seal 26. The o-rings 24 are for stability only, but upper seal 25 isolates the upper water entry ports 27 from the upper valve exits 28. Similarly, lower seal 26 isolates the lower water entry port 29 from lower valve exits 30.

For upper flow valve 22, upper water entry ports 27 communicate with axial passage 13 of mandrel 10 through the upper side pocket opening 15. In simplified terms, water is pumped from the surface to axial passage 13, through upper side pocket opening 15, through upper water entry ports 27, axially downwardly through upper flow valve 22, out upper valve exits 28, into valve exit chamber 40 and out of exit ports 14 of mandrel 10.

For lower flow valve 23, lower water entry port 29 communicates with axial passage 13 of mandrel 10 through lower side pocket opening 16. In simplified terms, water flows from axial passage 13 through lower side pocket opening 16, through lower water entry port 29, axially upwardly through lower flow valve 23, out lower valve exits 30, commingled in valve exit chamber 40 with water from upper flow valve 22 and out of exit ports 14 of mandrel 10. Thus, the maximum water flow rate from water valve assembly 20 is double the flow rate for a single maximum limited valve.

Figure 1A:
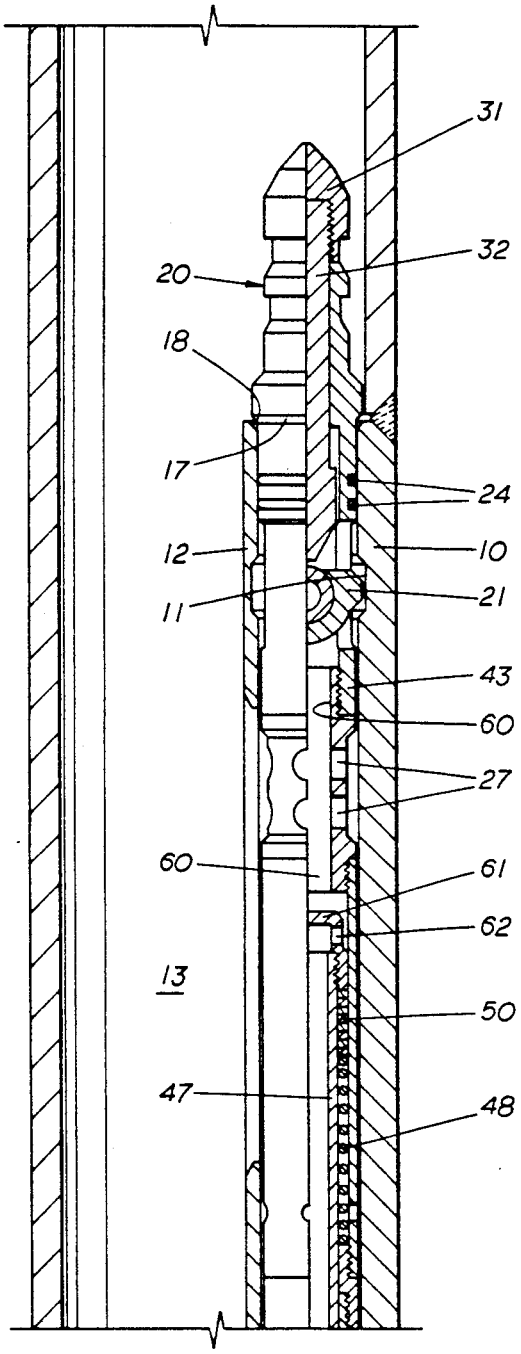
FIGS. 1A and 1B are side elevations in cross-section of the mandrel having a plurality of flow regulators (shown in partial cross-section) in a side pocket thereof.
Figure 1B:
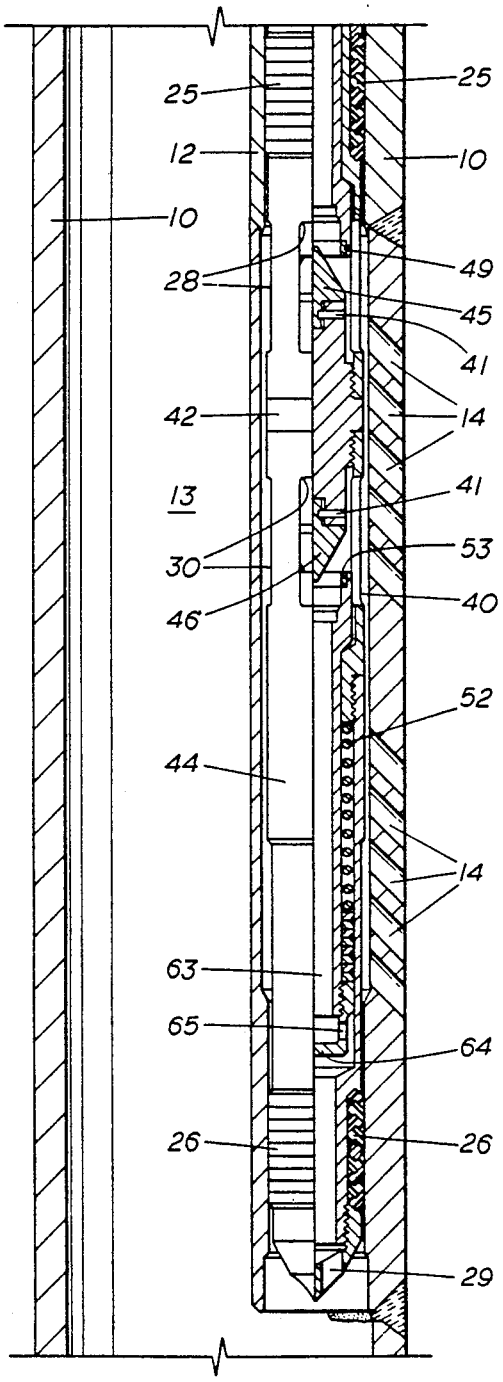

Water flow valve assembly 20, including both upper flow valve 22 and lower flow valve 23, may be inserted into and removed from side pocket 12 by use of a wireline (not shown). The wireline tool attaches to a fishing neck 31 and lowers water flow valve assembly 20 downward in the production string to the level of mandrel 10. The lower end of water flow valve assembly 20 is centered in side pocket 12 and allowed to slide its full length into side pocket 12 until the shoulder of water flow valve assembly 20 contacts the lip 18 of side pocket 12, as shown in FIG. 1A. Locking key 21, which is spring loaded to rotate clockwise as shown in FIG. 1A, rotates into engagement with locking detent 11 to secure water flow valve assembly 20 in side pocket 12. This latching means may be released as discussed below when water flow valve assembly is to be removed from side pocket 12.

Once water flow valve assembly 20 is in place within side pocket 12, upper valve exits 28 and lower valve exits 30 communicate with a valve exit chamber 40, which in turn, is open to exit ports 14. Valve exit chamber 40 is an annular space bounded by the outer surface of water flow valve assembly 20 and the inner surface of side pocket 12 between upper seal 25 and lower seal 26. The flow from upper flow valve 22 and lower flow valve 23 are commingled in valve exit chamber 40 and then expelled into the perforations in the adjacent formation through exit ports 14.

Figure 2A:
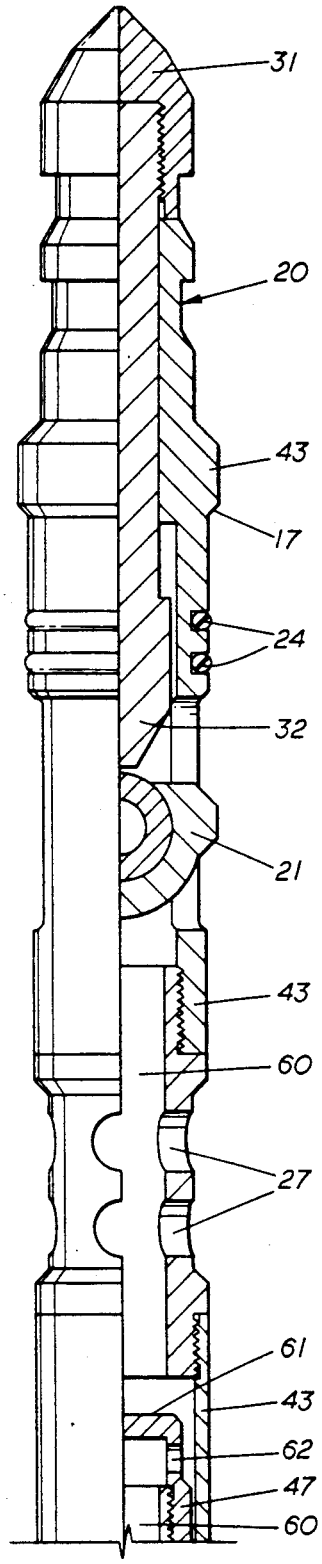
FIGS. 2A, 2B and 2C are partial cross-sectional views in side elevation of the upper, middle and lower portions, respectively, of the stacked water regulators which fit in the side pocket of the mandrel.
Figure 2B:
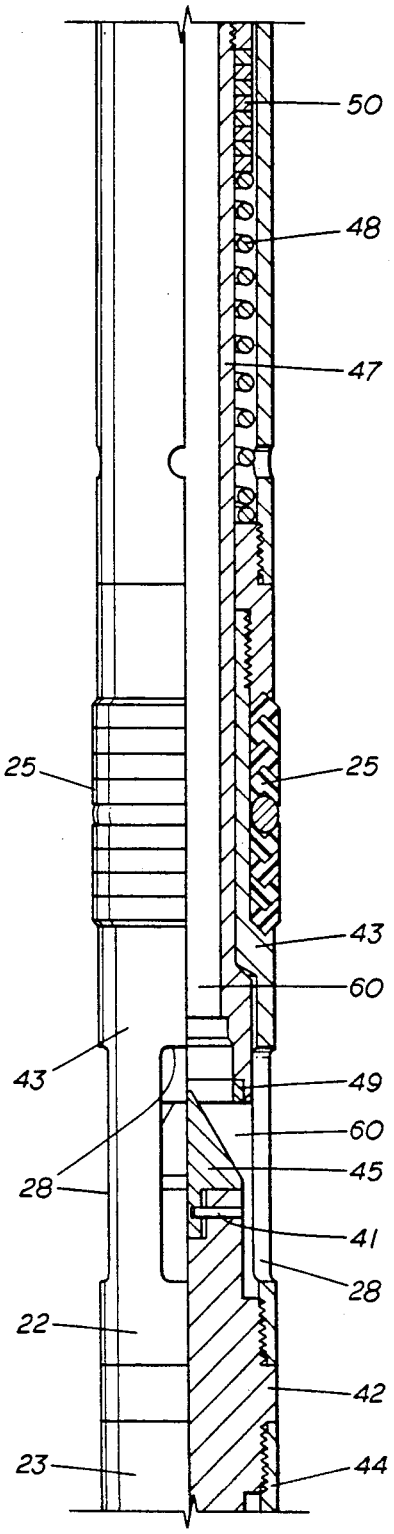
Figure 2C:
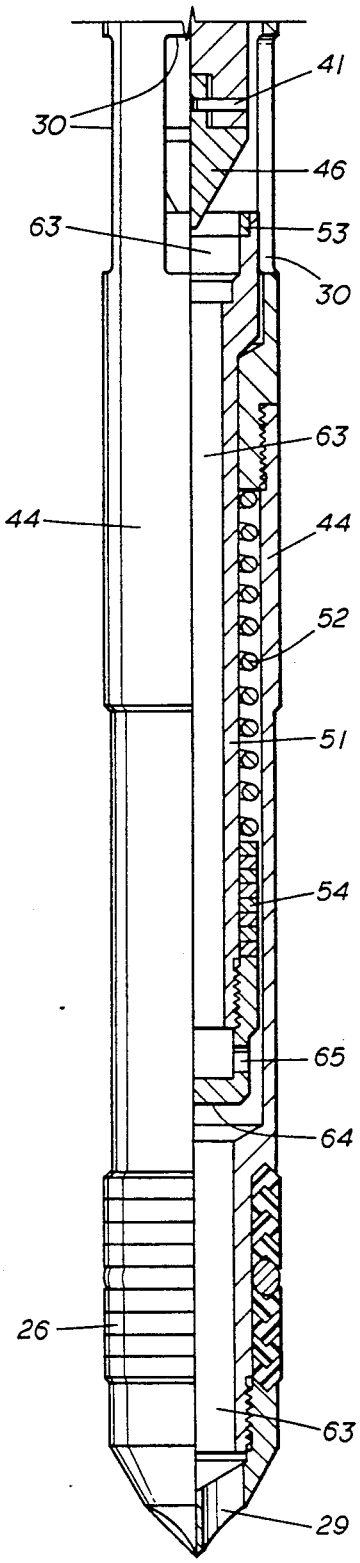

Referring now to FIGS. 2A–2C, water flow valve assembly 20, comprised of upper valve 22 and lower valve 23, is shown. In FIG. 2B, upper valve 22 and lower valve 23 are joined by threaded engagement with a connector 42. Connector 42 is threaded to upper valve body 43 at an upper portion of connector 42 and is threaded to lower valve body 44 at a lower portion of connector 42. Connector 42 includes at its uppermost portion an upper valve seat 45 and at is lowermost portion a lower valve seat 46. Connector 42 remains stationary with respect to upper valve body 43 and lower valve body 44.

Referring to FIGS. 2A and 2B, upper flow valve 22 is formed by upper valve body 43 which contains a cylindrical slidable upper sleeve 47 mounted concentrically therein. Upper sleeve 47 is biased in the open position by an upper spring 48 against the flow of water entering upper water entry ports 27, flowing down the upper water course 60, and bearing against the upper sleeve shoulder 61 prior to entering the axially central portion of upper sleeve 47 through the upper sleeve passage 62. The water continues downwardly through upper water course 60, now in the interior of upper sleeve 47 until it flows out upper valve exit 28 after passing through the opening between upper valve seat 45 and upper sleeve skirt 49. The tension on upper spring 48, as adjusted by the upper spacers 50, determines the maximum flow rate of water through upper water course 60. The greater the tension imparted by upper spring 48, the larger the opening will be between upper sleeve skirt 49 and upper valve seat 45. The pressure of water downwardly through upper water course 60 bearing on upper sleeve shoulder 61 (thereby creating a pressure differential across upper sleeve passage 62) tends to close the passage between upper sleeve skirt 49 and upper valve seat 45. The greater the rate of flow, the narrower that passage becomes. Thus, the aforementioned parts of upper flow valve 22 operate to impose a maximum flow rate on water allowed to pass through upper water course 60.

Referring now to FIGS. 2B and 2C, lower flow valve 23 is formed by lower valve body 44, which contains the cylindrical slidable lower sleeve 51. Lower sleeve 51 is biased against the flow of water entering lower water entry port 29 flowing up the lower water course 63 and bearing against the lower sleeve shoulder 64 (and creating a pressure differential across lower sleeve passage 65) prior to entering the axially central portion of lower sleeve 51 through the lower sleeve passage 65. The lower spring 52, adjusted by the lower spacers 54, supplies the force to upwardly bias lower sleeve 51. Similar to the operation of upper flow valve 22, lower flow valve 23 limits the maximum flow rate of water through lower water course 63.

Upper valve seat 45 and lower valve seat 46 are within a limited range of motion, free to move to seat within upper sleeve skirt 49 and lower sleeve skirt 53, respectively, as skirt 49 moves closer to upper valve seat 45 or as lower sleeve skirt 53 moves closer to lower valve seat 46. Seat 45 is mounted on the seat pins 41. Seat pins 41 are tacked into connector 42 loosely so as to permit limited radial and longitudinal movement of upper valve seat 45 and lower valve seat 46 relative to connector 42.

Together, upper flow valve 22 and lower flow valve 23 supply twice the maximum flow of injected water which could be achieved with a single limiting flow valve and may be inserted and extracted from side pocket 12 in a single wireline trip.

At the start of water injection into a formation, pressure differential across the valve is great. As the formation fills with fluid that pressure differential gets smaller and the pressure differential across the orifice at upper sleeve passage 62 and lower sleeve passage 65 becomes smaller if the sleeve skirt maintained the same position. If this occurred, the flow rate would drop. But upper spring 48 and lower spring 52 set at a selected force, opens the passages between upper sleeve skirt 49 and upper valve seat 45 and between lower sleeve skirt 53 and lower valve seat 46 to permit flow through water flow valve assembly 20 to be maintained at a constant rate.

When it is desired to remove water flow valve assembly 20 from side pocket 12, a fishing tool (not shown) engages the fishing neck 31 which is threaded to the inner piston 32. Inner piston 32 is slidably mounted for axial movement in upper flow valve 22 and is secured by a shear pin (not shown) in the position shown in FIG. 2A. When a sharp upward force is exerted on fishing neck 31 by the wireline tool, inner piston 32 shears the shear pin and moves upwardly relative to upper valve body 43 and locking key 21. When inner piston 32 moves away from spring-loaded locking key 21, locking key 21 rotates clockwise and out of engagement with locking detent 11 of mandrel 10. Water flow valve assembly 20 may then be pulled by the wireline from side pocket 12 up the injection tubing to the surface.

Thus it can be seen that a novel water regulator has been shown. Certain modifications may be made in the preferred embodiment, parts may be reversed, and alternative mechanisms can be employed within the scope of the invention as will be apparent to one skilled in the art in view of the above description.

What is claimed is:

1. In apparatus for injecting liquids into an underground formation from a bore hole therein, the combination comprising:

a mandrel having an axial passage therethrough and a single side pocket along its longitudinal axis for receiving a multiplicity of liquid flow regulation means, said side pocket being in fluid communication along an upper and lower portion thereof with said axial passage and adapted for fluid communication with a subterranean formation along a central portion of said side pocket;

a single latching means for securing said flow regulation means in said side pocket; and, a multiplicity of longitudinally aligned and physically connected liquid flow regulation means adapted to be inserted in said side pocket for regulating at least two liquid flow streams from said axial passage to a common exit port in said mandrel.

2. The apparatus as claimed in claim 1, wherein:

each of said liquid flow regulation means permits only a predetermined maximum flow rate from said axial passage to said formation.

3. In a method for injecting fluids into a subterranean formation from a mandrel adjacent to said formation, the steps comprising:

flowing a liquid within said mandrel to said formation under pressure through at least two axially opposite flow paths;

limiting said flow along each of said paths to predetermined maximum flow rate; and, combining said flow of said flow paths within said mandrel after said limiting step and prior to injection into said formation.

* * * * *